US008839838B2

(12) United States Patent
Parkhe

(10) Patent No.: US 8,839,838 B2
(45) Date of Patent: Sep. 23, 2014

(54) ADHESIVE TAPE DISPENSER

(71) Applicant: Dattatrya Purushottam Parkhe, San Jose, CA (US)

(72) Inventor: Dattatrya Purushottam Parkhe, San Jose, CA (US)

(73) Assignee: Dattatraya Parkhe, San Jose, CA (US)

( * ) Notice: Subject to any disclaimer, the term of this patent is extended or adjusted under 35 U.S.C. 154(b) by 0 days.

(21) Appl. No.: 13/668,373

(22) Filed: Nov. 5, 2012

(65) Prior Publication Data

US 2014/0124145 A1 May 8, 2014

(51) Int. Cl.

| | |
|---|---|
| ***E04D 15/00*** | (2006.01) |
| ***B65H 35/00*** | (2006.01) |
| *B26F 3/02* | (2006.01) |
| *B29C 65/00* | (2006.01) |
| *B32B 38/10* | (2006.01) |
| *B44C 7/00* | (2006.01) |

(52) U.S. Cl.

CPC ..... *B65H 35/0013* (2013.01)

USPC ..... 156/577; 156/579; 156/527; 156/574; 225/65; 225/66; 225/57; 225/88; 225/56

(58) Field of Classification Search

USPC ..... 225/77, 6, 61, 91, 47, 65, 66, 78, 56, 225/58, 39, 19, 88, 70, 90, 51, 52, 55, 59, 225/84, 85, 86, 87; 156/577, 250, 527, 523, 156/574, 579, 510

See application file for complete search history.

(56) References Cited

U.S. PATENT DOCUMENTS

| | | | | | |
|---|---|---|---|---|---|
| 2,447,518 | A * | 8/1948 | Marinsky | 225/22 |
| 2,469,247 | A * | 5/1949 | Smith | 225/66 |
| 2,717,641 | A * | 9/1955 | Wiederspan | 225/65 |
| 2,734,575 | A * | 2/1956 | Gilbreth et al. | 225/56 |
| 2,788,181 | A * | 4/1957 | Anderson | 225/65 |
| 2,999,313 | A * | 9/1961 | Emmert | 83/611 |
| 3,138,310 | A * | 6/1964 | Blodee | 225/65 |
| 3,140,805 | A * | 7/1964 | Seror | 225/66 |
| 4,496,276 | A * | 1/1985 | Shulyak | 225/65 |
| 4,957,234 | A * | 9/1990 | Orlandini | 225/65 |
| 2010/0096427 | A1 * | 4/2010 | Chen | 225/56 |

* cited by examiner

*Primary Examiner* — Philip Tucker
*Assistant Examiner* — Alex Efta

(57) ABSTRACT

This Dispenser having a cutter plate, which is flexibly mounted on a Tape roll, helps in peeling the Tape and is able to cut it by serration provided at the other end.

There is an open space, in between the rod and cutter plate, so that Tape can be drawn over from both sides of the dispenser, to cut it by serrations present at the other end.

On the cutter plate of the Dispenser, there is a notch and a hole is provided, so that, the cut end of the tape which sticks on the plate, can be easily removed for the next operation.

This cutter plate assembly being flexibly attached on a Tape roll, by means of two 0 rings, can swivel like a hinge, so that Tape can be cut at any desired and from a suitable angle.

A double cutter is provided to hold a firm grip on the tape, to cut it easily, besides, to protects from injury also.

Thus It is a novel, Tape Dispenser which is User friendly, Multipurpose and a unique and most simple in Design, useful for most of varieties of Tapes, having variations in, Materials, Widths, Diameters, Thickness, Toughness, Stickiness, and various Applications and Uses. Most suitable for a common Man, Office, Industry and Packaging use in Industry.

6 Claims, 16 Drawing Sheets

ADHESIVE TAPE DISPENSER

CROSS REFERENCE TO RELATED APPLICATION

This Application Claims the benefit of provisional Patent Application Patent number Ser. no. 3144 Mumbai filed 2011 Nov. 8 by the present Inventor in India

FEDERALLY SPONSORED RESEARCH

Not Applicable

SEQUENCE LISTING: OR PROGRAM

Not Applicable

This Invention relates to Adhesive Tape Dispenser which are used to dispense Tapes from various types of Tape Rolls

PREAMBLE TO THE DESCRIPTION

The following specification particularly describes the invention and the manner in which it is to be performed.

FIELD OF THE DISCLOSURE

The present disclosure generally relates to a tape dispenser for dispensing a desired length of tape rolled on a tape-reel, more particularly, the present disclosure relates to a tape dispenser for dispensing a desired length of adhesive-tape from an adhesive-tape reel.

BACKGROUND

A tape reel includes a core in form of a roller around which an adhesive tape that has a sticky side and a glossy side is wound. The tape may be made from plastic material. The adhesive tape is wound over the tape reel in such a manner that the sticky side of the adhesive tape is facing inwardly and a glossy side of the adhesive tape is facing outwardly. More specifically, the sticky side of a layer of the adhesive tape removably sticks to the glossy side of the layer disposed underneath thereof and can be separated off from the underneath layer by applying a dragging force on the layer.

The user of the adhesive tape desirous of dispensing a length of adhesive tape from the tape reel has to locate the free end of the adhesive tape so as to enable the user to hold the free end of the adhesive tape and apply dragging force on the adhesive tape. However, it becomes difficult for a person even with a normal vision to locate the free end of the adhesive tape. Further, it is a tedious task to locate the free end of the adhesive tape for each subsequent use and a lot of time and effort is wasted in locating the free end of the tape.

Further, the cutting of the adhesive tape requires a separate cutter. At times, it becomes difficult to locate the cutter, while the desired length of the tape has already been dispensed from the tape reel. In such cases the user may try to cut the tape by pulling the tape or using teeth for cutting the tape. However, both the methods for cutting desired length of tape have drawbacks associated therewith, particularly; the first method may damage the tape while the second method is unhygienic.

A variety of adhesive tape dispensers available in the market are provided with cutters secured thereto to facilitate dispensing a desired length of adhesive tape from the adhesive tape dispensers. More specifically, such tape dispensers include a tape-roll mounted on a bearing mechanism to facilitate rolling of the tape-roll. As a free end of the tape supported on the tape-roll is dragged to dispense the tape from the tape roll, the tape roll rotates with respect to the bearing mechanism to facilitate dispensing of the tape.

As a desired length of the tape is dispensed from the tape-roll, the tape is cut by a cutter disposed at a distance from the tape roll mounting. Further, after the desired length of the tape has been cut by the cutter, the free end of the tape sticks on the cutter that acts as a stay to facilitate locating of the free end of the tape for subsequent uses. However, such adhesive tape dispensers are clumsy, involve more number of hardware components, difficult to handle and operate. Further, mounting of the tape roll on the bearing mechanism of the tape dispenser is a tedious task.

Further, in case of duct tapes, the sticky side of the tape is very sticky and it requires a large dragging force for separating the subsequent layers of the tape from each other. Such high dragging forces may damage the tape. The damage caused to the tape due to dragging forces applied thereon for dispensing the tape from the roll may be aggravated if the tape is made of fragile material such as paper or film. Further, if the dragging forces are transmitted to the tape dispenser, the tape dispenser may get damaged. In order to prevent damages to the tape dispenser due to high dragging forces transmitted thereto, additional hardware components are configured on the tape dispenser. Accordingly, in the case of a tape dispenser for duct tape, the tape dispenser is made rigid, thereby increasing manufacturing cost of the tape dispenser. Still further, such adhesive tape dispensers lack arrangement for preventing sticking of the adhesive tape back to the roll from which it has been dispensed.

Still further, in case of the adhesive tape dispensers known in the prior art there is no provision for ensuring positive safety for the adhesive tape against any damage thereof. Still further, in case of wider adhesive tapes, area of the adhesive is greater as such more force is required for overcoming the adhesive forces and separating the subsequent layers of the tape, accordingly, the adhesive tape dispensers known in the prior art are in-effective in dispensing wider tapes as the adhesive tape dispensers of the prior art utilize dragging forces.

Still further, the adhesive tape dispenser known in the prior art is difficult to use. More specifically, as a user drags the tape from the tape dispenser, the tape dispenser may also get dragged as a result of the dragging forces. In order to prevent the tape dispenser from dragging, the tape dispenser is made heavy or the tape dispenser is mounted on a worktable, both methods for preventing the tape dispenser from sliding have drawbacks associated therewith. If the tape dispenser is made heavy, the manufacturing cost of the tape dispenser is increased. If the tape dispenser is mounted on the work-table, its portability is hampered. Attempts have been made in prior art to use a cutter designed from a single wire.

The user of the adhesive tape desirous of dispensing a desired length of adhesive tape from the tape reel has to locate the free end of the adhesive tape and apply dragging force on the adhesive tape, with effect to this, the adhesive tape dispenser is required to have a heavy construction for dispensing the tape by dragging, so that the main body of the adhesive tape dispenser need not move when dragging force is applied on the tape. Accordingly, the overall mass as well as cost of the adhesive tape dispenser increases.

The adhesive tape dispensers known in the prior art include a stay on which a free end of the adhesive tape dispensed from the roll can stick, thereby facilitates location of the free end of the adhesive tape for subsequent uses thereof. However, adhesive tape dispensers known in the prior art have drawbacks associated therewith, for example, the stay used with the convention tape dispensers fail to hold the tape firmly while dispensing the tape and the tape may stick back to the roll, thereby causing a lot of in-convenience. More specifically, the adhesive tape may slip from the stay which is provided to stick the tape there-to and becomes difficult to separate there-from.

Still further, the stay on which the free end of the adhesive tape sticks is generally disposed at a distance from the bearing mechanism on which the tape-roll is mounted. Such a configuration of the adhesive tape dispenser keeps the sticky surface of adhesive tape supported between the stay and the tape-roll constantly in contact with moist, dusty environment that may de-grade the sticky side of the adhesive tape supported between the stay and the tape-roll and result in wastage of that part of the tape. Still further, the adhesive tape dispenser supported between the stay and the tape-roll sags there-between and a sticky face of the tape may touch a bottom portion of the tape dispenser, stick to it and get damaged.

The adhesive tape dispenser in accordance with the prior art is prone to cause accidents. More specifically, the adhesive tape dispenser in accordance with the prior art is having a configuration such that the user has to drag the desired length of the tape up-to the cutter and press the tape against the cutter disposed beneath the tape. As the tape gets cut by the cutter, the user's hand holding the free end of the tape remains in motion due to inertia and may hit a hard surface. Still further, as the cutter used in the prior art adhesive tape dispenser is having sharp cutting edges that are exposed and not covered such cutting edges may cause accidents.

Furthermore, the adhesive tape dispenser known in the prior art are configured for handling a particular tape dimension only and fail to handle tapes of different dimensions. Still further, the adhesive tape dispenser known in the prior art requires the tape to be dragged while dispensing; such dragging action may cause jerks and damage the tape. In order to facilitate smooth rolling of the tape while dragging and smooth drawing of the tape from the tape roll additional hardware components are required. Still further, the tape dispensers of the prior art fail to rewind the tape in case an excess length of the adhesive tape has been dispensed by the tape dispenser. Accordingly, this may cause wastage of the tape.

Further, the adhesive tape dispenser known in the prior art fails to cater different widths of tape, accordingly, adhesive tape dispensers of different configurations are required for catering different widths of adhesive tapes. In accordance with another tape dispenser known in prior art the adhesive tape roller is encapsulated in a casing which is provided with a cutter assembly configured thereon. However, such an encapsulated arrangement lacks flexibility to be used for different dimensioned adhesive tape rollers. Accordingly, the adhesive tape dispenser includes a plurality of hardware components, thereby making the adhesive tape dispenser prone to wear related problems and thereby require frequent maintenance. Furthermore, the adhesive tape dispenser known in the prior art is expensive.

Accordingly, there is a need for an arrangement for handling adhesive tape, more particularly, an adhesive tape dispenser that is simple in construction, in-expensive and user friendly. Furthermore, there is a need for an adhesive tape dispenser that eliminates the dragging operation for dispensing the tape there-from and accordingly eliminates the drawbacks associated with dragging of the tape for dispensing the tape.

Still further, there is a need for an adhesive tape dispenser that prevents sticking of the tape dispensed off from the tape roll back to the roll. Further, there is a need for an adhesive tape dispenser that is adapted to be used for adhesive tapes of varying dimensions. Further, there is need for an adhesive tape dispenser that may be easily mounted on the tape roll and flexibly folded thereon to facilitate convenient packaging of the adhesive tape dispenser along with the tape roll.

STATEMENT OF THE INVENTION

A tape dispenser comprising a flexible frame to be detachably mounted on a tape roll for dispensing a desired length of tape is described. The frame travels along the circumference of the tape roll to cut predefined length of a tape. A cutter plate is rotatably coupled to the frame and a window defined by a lower portion of the cutter plate and a pair of legs is adapted to receive the tape form either side.

SUMMARY OF THE INVENTION

A tape dispenser to be detachably mounted on a tape roll for dispensing a desired length of tape is described. The adhesive tape dispenser includes a flexible frame, a pair of flexible bands and a first rod. The flexible frame is defined by a rod and cutter plate assembly. The rod and cutter plate assembly includes a second rod, a cutter plate, wherein the cutter plate includes a proximal end and a distal end. The distal end of the cutter plate includes serrations provided to facilitate cutting of the adhesive tape peeled off from the adhesive tape roll. The second rod of the rod and cutter plate assembly rolls over the roll to facilitate floating of the rod and cutter plate assembly over the roll and peeling of the tape for dispensing the tape from the roll.

The cutter plate is rotatably coupled to the frame with a pair of flexible bands. The flexible band is selected from one or more of the following elastic material, rubber band, spring like structure and combinations thereof. A window is defined by a lower portion of the cutter plate and a pair of legs. The window is adapted to receive the tape form either side. The legs are removably secured to the extreme ends of the outer rod of the frame to facilitate swiveling of the cutter plate.

The cutter plate includes at least one notch and a central aperture adapted to facilitate convenient removal of the tape. The tape cutter also includes a paper, for example silicon paper, on either side adapted to removably hold a free end of the tape.

In another embodiment the adhesive tape dispenser includes a plurality of cutter plates, each configured to cater different widths of adhesive tape rollers. The cutter plates are adapted to cut the adhesive tape from both sides.

In yet another embodiment the adhesive tape dispenser includes a box, a rod and a cutter plate. In this embodiment, the tape roll is enclosed in the box. The box includes an opening and a pair of notches adapted to facilitate peeling of the tape from box and to hold the uncut portion of the tape for further cutting.

In yet another embodiment tape dispenser includes a rod to be mounted on a tape roll and at least one tape cutter securely coupled with a pair of plates positioned on extreme ends of the rod. The plates are preferably aligned in parallel or traversal with the rod. Cutter plates are coupled in a known way to define a pin joint. Cutter plates define a groove adapted to adjust in accordance with the width of the tape to be cut.

Adhesive tape dispenser of present invention is user friendly, multipurpose and simple in design. Adhesive tape dispenser is useful for all varieties of tapes having variations in materials, widths, diameters, thickness, toughness, stickiness. The adhesive tape dispenser in accordance with the present invention can be used in industries where adhesive tapes are frequently and continuously used such as packaging industry, as the adhesive tape dispenser in accordance with the present invention is simple and convenient to use.

BRIEF DESCRIPTION OF THE ACCOMPANYING DRAWINGS

The above mentioned and other features, aspects and advantages of the present invention will become better understood with regard to following description, appended claims and accompanying drawings, wherein like reference numerals refer to similar parts throughout the several figures where:

Figure 6:
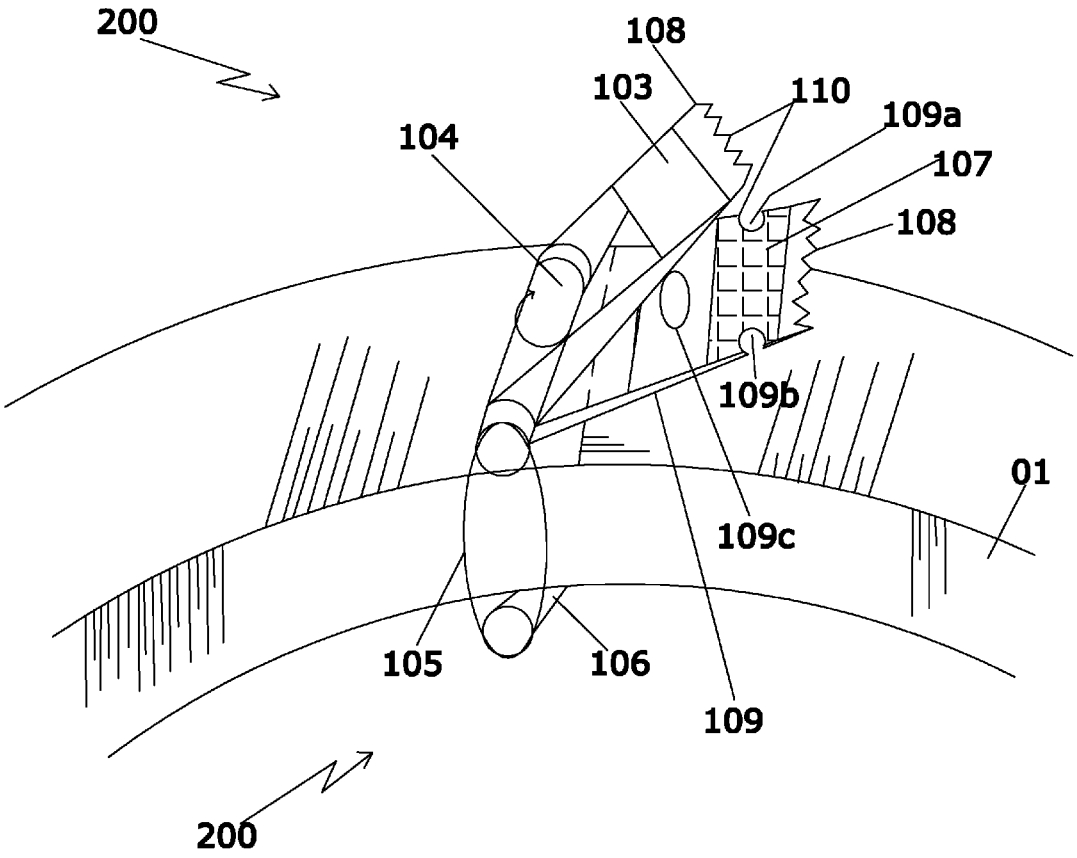
FIG. 6 is a front perspective view of an another embodiment of the tape dispenser of FIG. 1 having a cutter plate and a sticking plate.
Figure 8A:
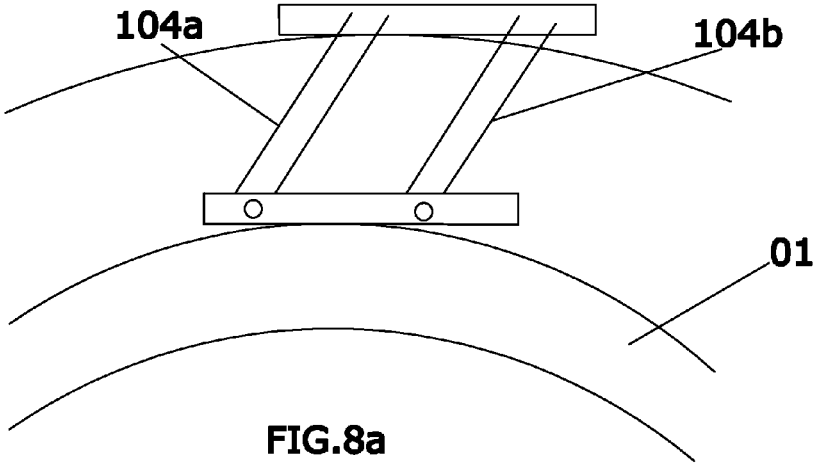
Figure 8B:
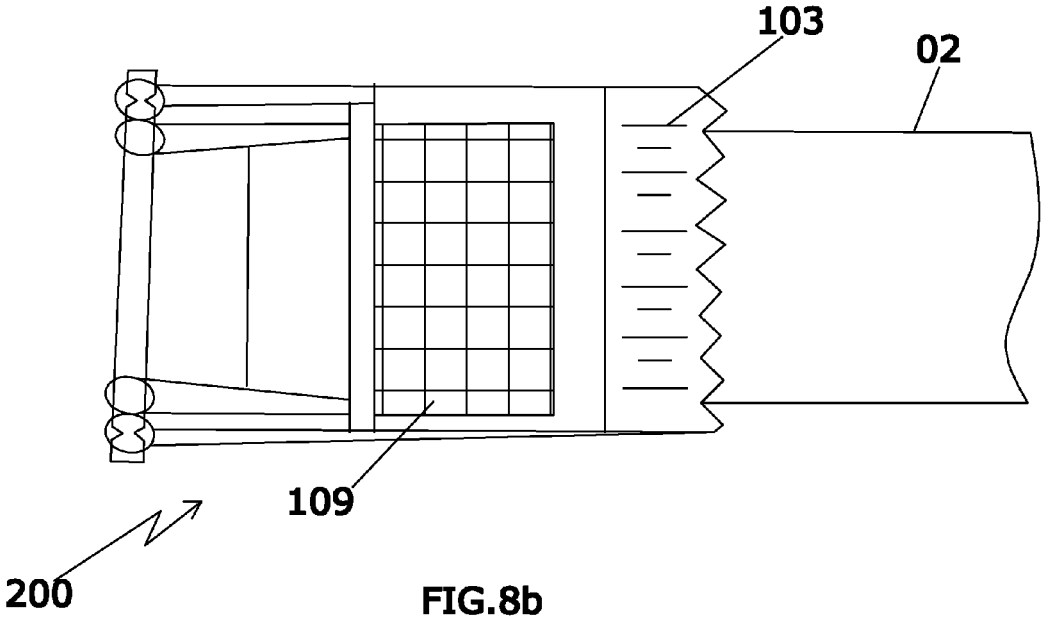
Figure 9:
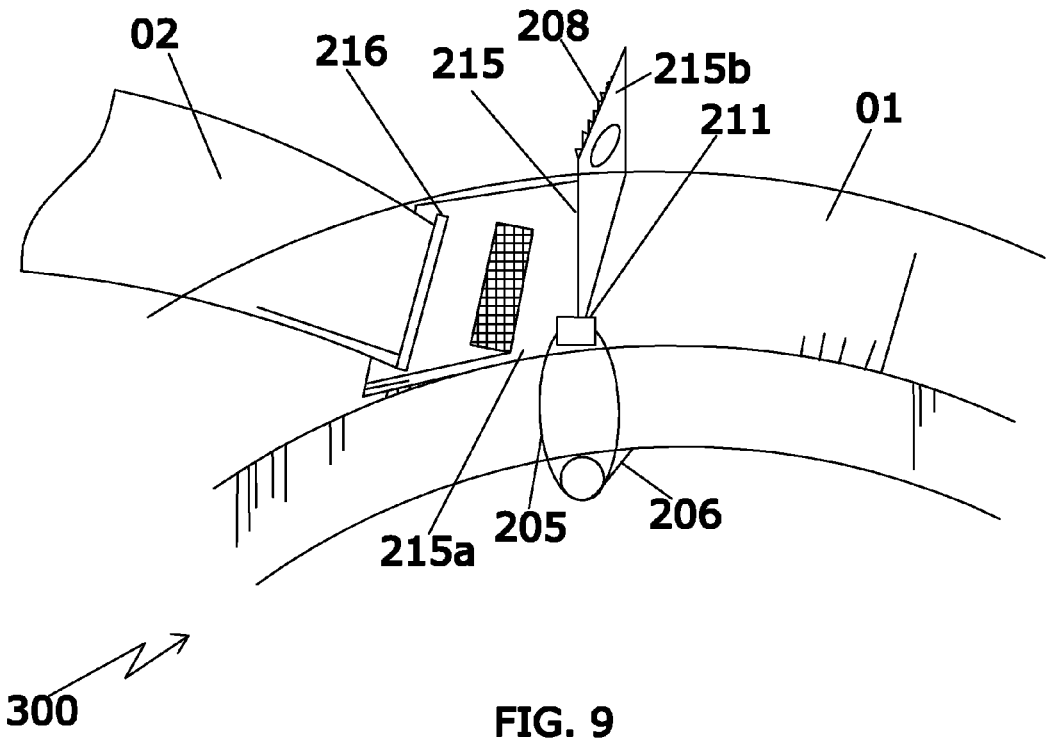
Figure 10:
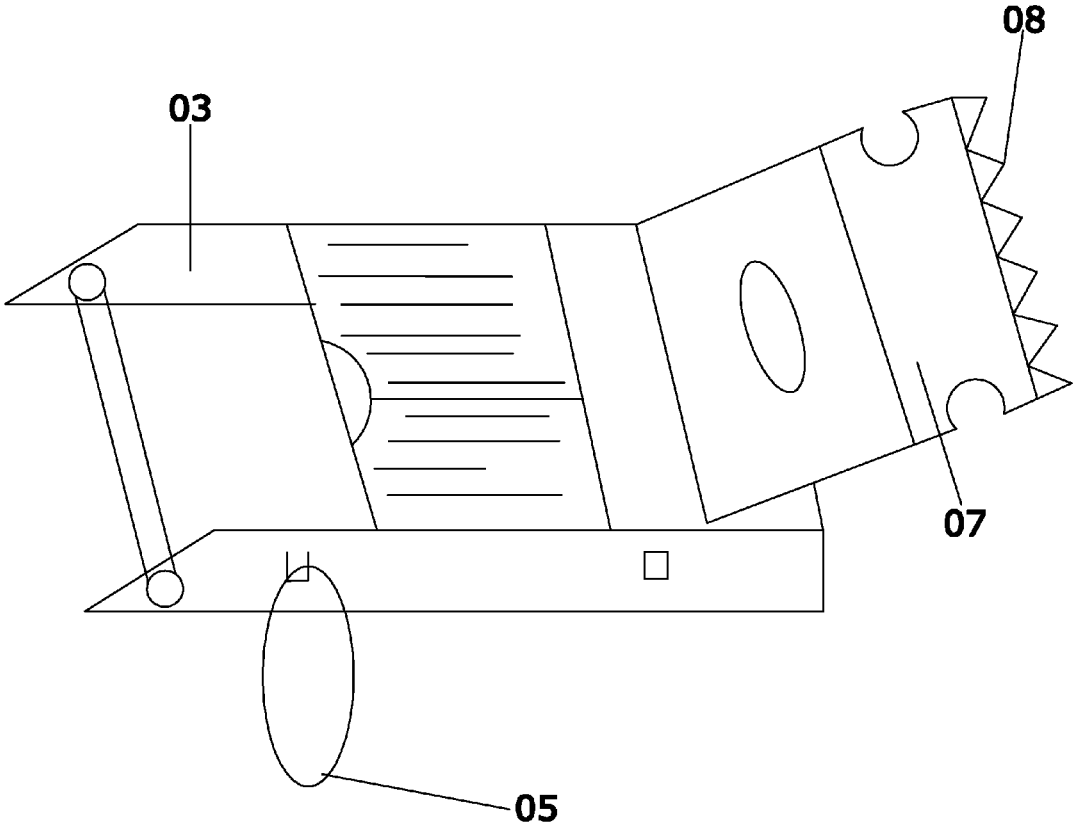
Figure 11A:
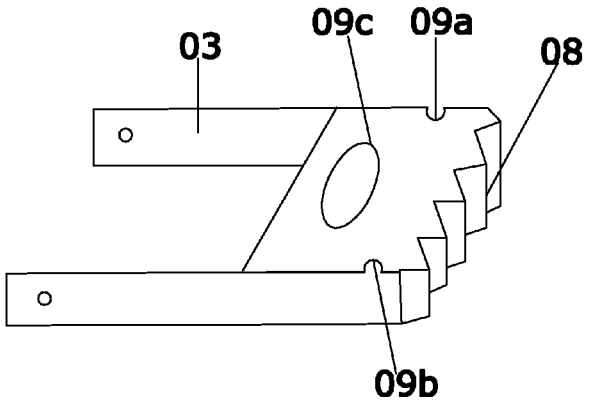
Figure 11B:
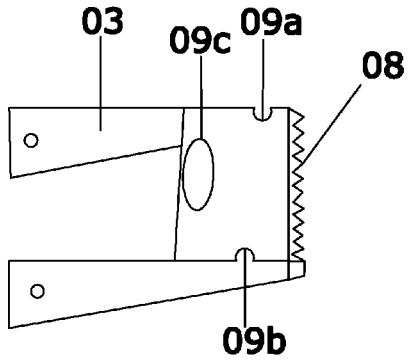
Figure 11C:
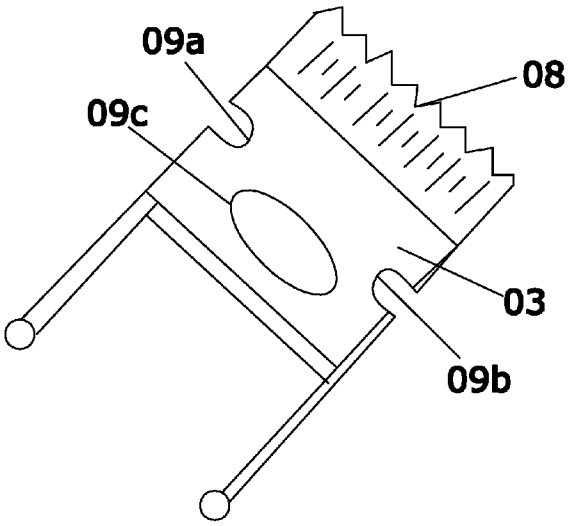
Figure 11D:
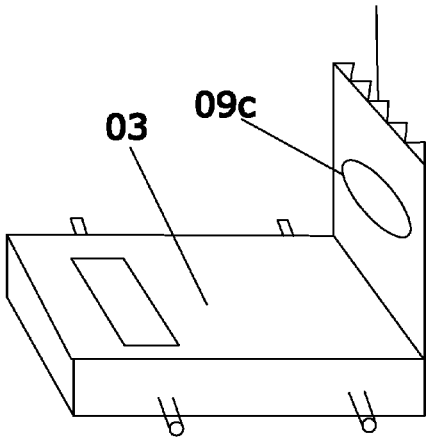
Figure 12A:
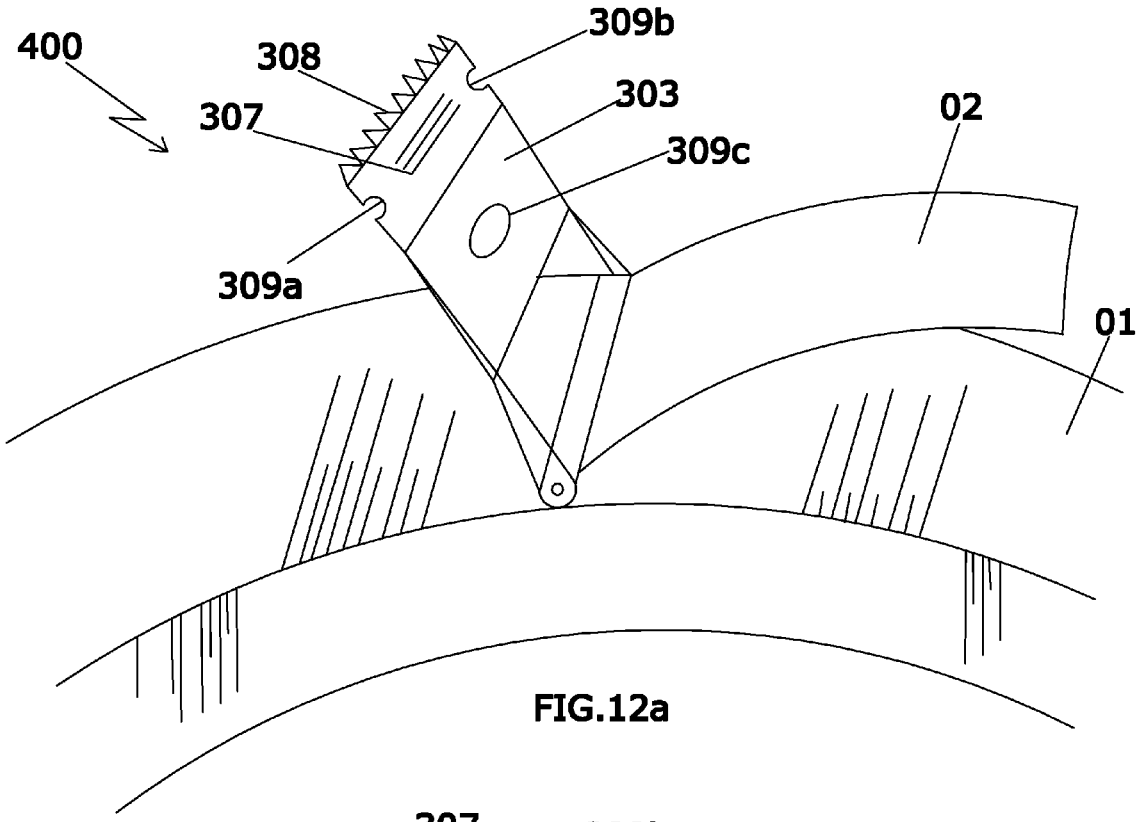
Figure 12B:
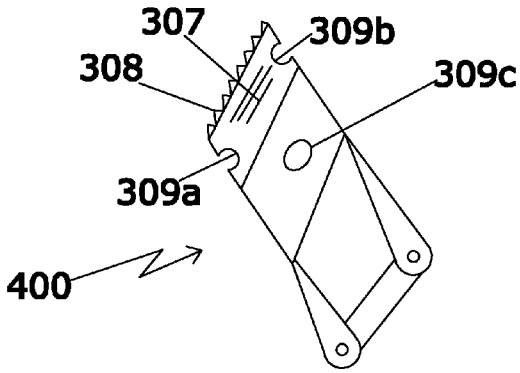
Figure 13:
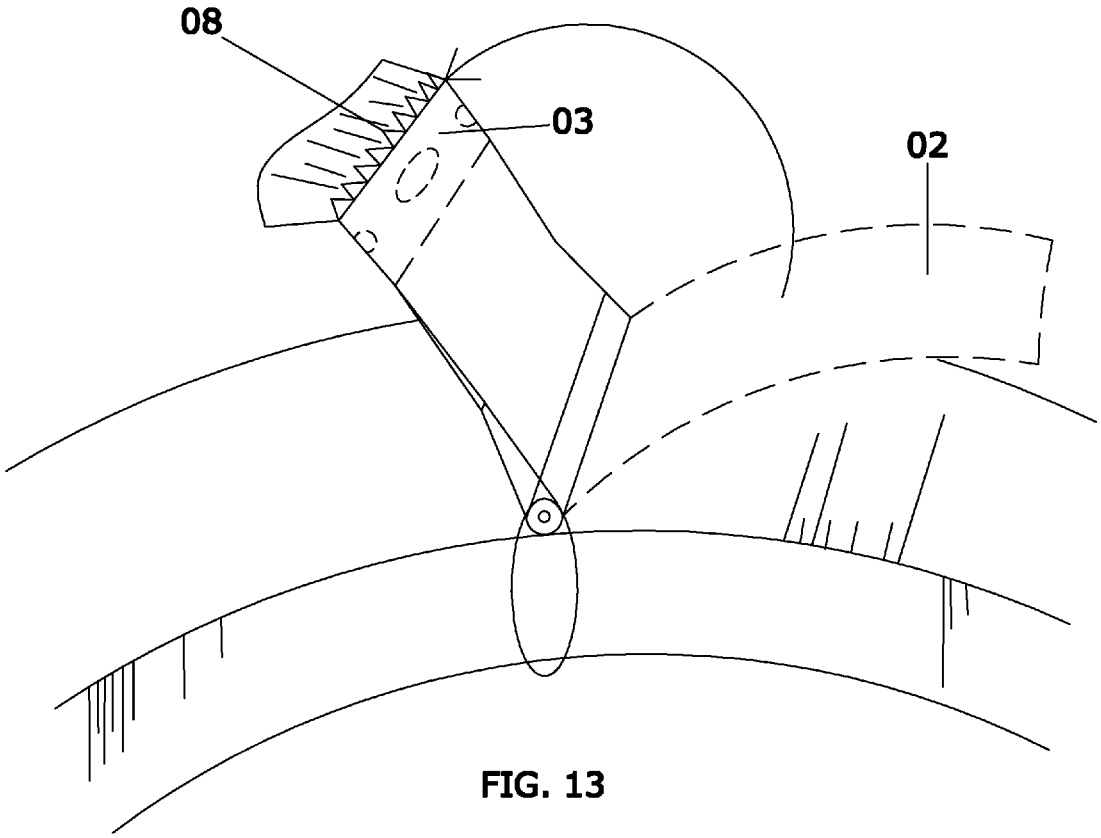
Figure 14:
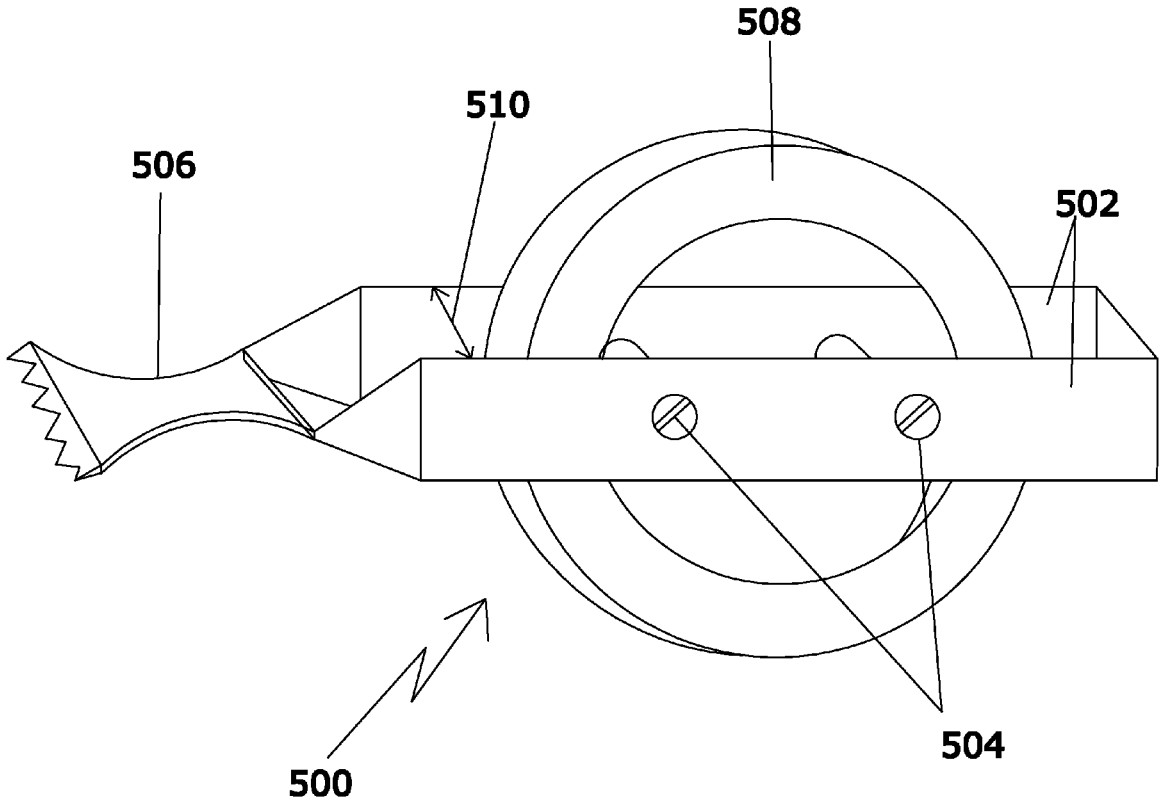
Figure 15:
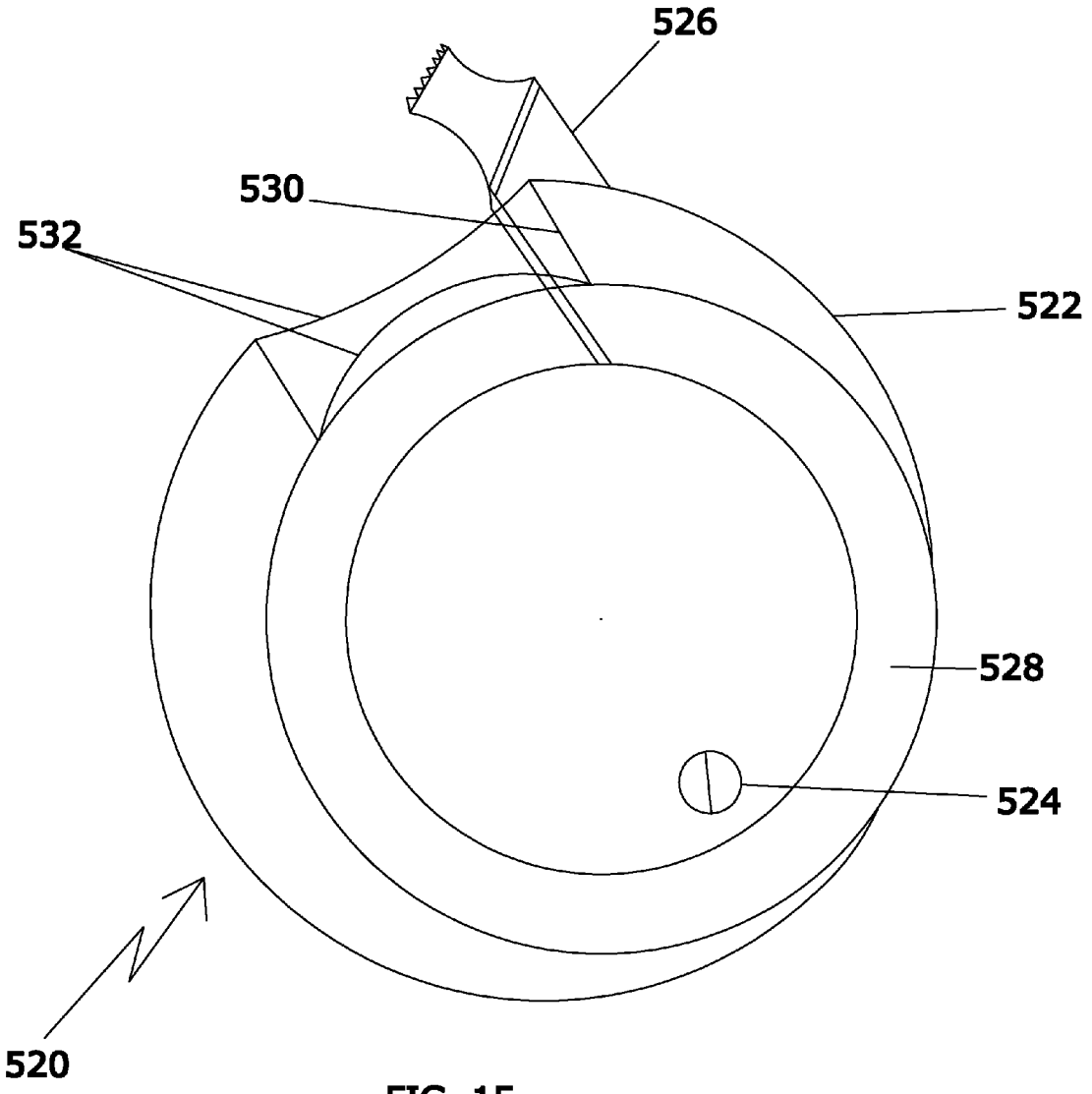
Figure 16:
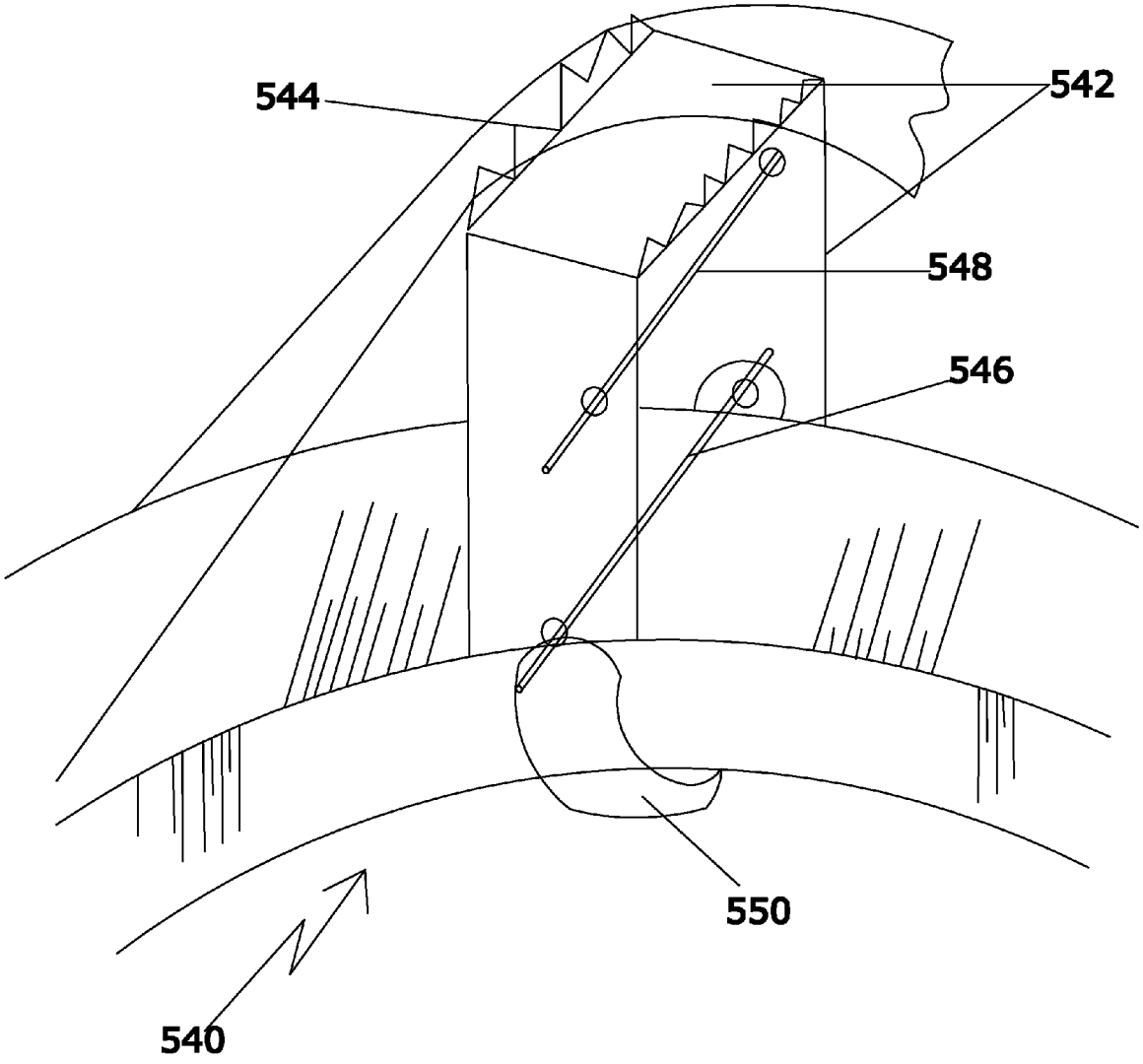

FIG. 8*a* is a side perspective view of the tape dispenser of FIG. 6 that shows a pair of rods for supporting sticking plate and cutter plate;

FIG. 8*b* is top view of the adhesive tape dispenser of FIG. 6 with the cutter plate and the sticking plate gripping the tape;

FIG. 9 shows another embodiment of the adhesive tape dispenser in accordance with the present invention;

FIG. 10 is a top perspective view of the rod and cutter plate assembly of the tape dispenser;

FIGS. 11*a*-11*d* show various structural configurations of the plate for the adhesive tape dispenser of FIG. 1, FIG. 6, FIG. 9 and FIG. 10;

FIG. 12*a* is a front perspective view of the tape dispenser that shows cutter plate and tape;

FIG. 12*b* is a side view of another embodiment of the tape dispenser of FIG. 12*a* that shows cutter plate;

FIG. 13 is a front perspective view of the adhesive tape dispenser with an arrangement for covering the serrations provided on the cutter plate;

FIG. 14 is a side perspective view of another embodiment of the tape dispenser that shows a pair of plates holding the tape;

FIG. 15 is a side view of the tape dispenser in accordance with one another embodiment of the present invention; and FIG. 16 is a front perspective view of the tape dispenser in accordance with yet another embodiment of the present invention.

DETAILED DESCRIPTION

Although specific terms are used in the following description for sake of clarity, these terms are intended to refer only to particular structure of the invention selected for illustration in the drawings, and are not intended to define or limit the scope of the invention.

An adhesive tape dispenser in accordance with the present invention is mounted on a tape roll and prevents sticking of the adhesive tape back to the tape roll after the adhesive tape has been peeled-off the tape roll, thereby facilitate locating of a free end of the adhesive tape for subsequent uses thereof. The adhesive tape dispenser in accordance with the present invention utilizes peeling mechanism for dispensing the tape rather than using the dragging mechanism as used in the tape dispensers of the prior art.

Figure 1:
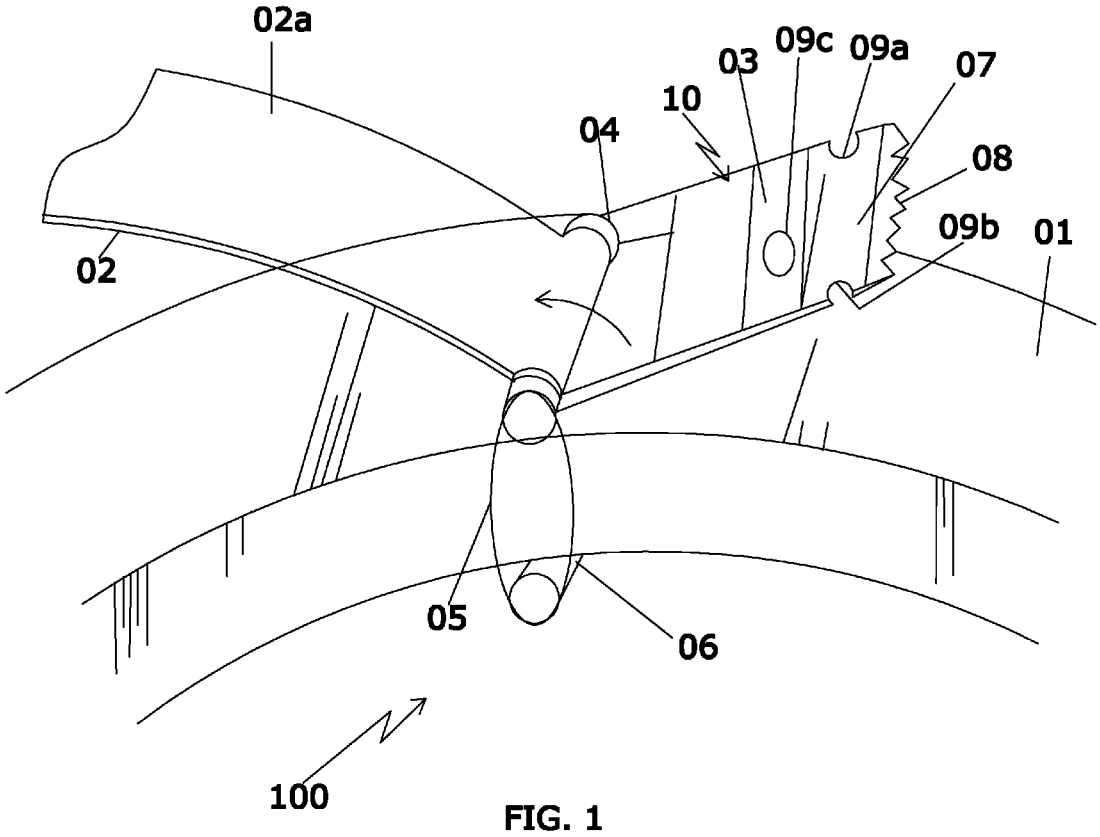
FIG. 1 is a front perspective view of an adhesive tape dispenser mounted on a tape roll in accordance with a preferred embodiment of present invention.

Referring to FIG. 1, an adhesive tape dispenser 100 in accordance with a preferred embodiment of the present invention is mounted on a tape roll 01. The adhesive tape dispenser 100 includes a flexible frame defined by a rod and cutter plate assembly 10; a pair of O-rings/flexible bands each referred to as 05, and an elongate bush member/a first rod 06. The rod and cutter plate assembly 10 includes a second rod 04, a cutter plate 03, wherein the cutter plate 03 includes a proximal end and a distal end, the distal end of the cutter plate 03 includes serrations 08 provided to facilitate cutting of the adhesive tape peeled off from the adhesive tape roll 01. The second rod 04 of the rod and cutter plate assembly 10 rolls over the roll 01 to facilitate floating of the rod and cutter plate assembly 10 over the roll 01 and peeling of the tape for dispensing the tape from the roll 01. In this preferred embodiment, length of cutter plate 03 is 4 cm. It is, understood, however, that width of cutter plate 03 may vary in other alternative embodiments per intended use of tape dispenser 100.

The distal end of the cutter plate 03 also includes a silicon paper 07 secured thereto. Instead of silicon paper, Teflon paper may also be secured to the distal end of the cutter plate 03. The silicon paper 07 or Teflon paper are having such surface properties that enable removably holding of a free end of the tape and easy peeling of the tape from the surface thereof and maintaining minimum contact between the free end of the tape and cutter plate 03. However, the present invention is not limited to a particular kind of paper secured to the distal end of cutter plate 03 as far as the surface of the paper exhibits desired properties.

Figure 2:
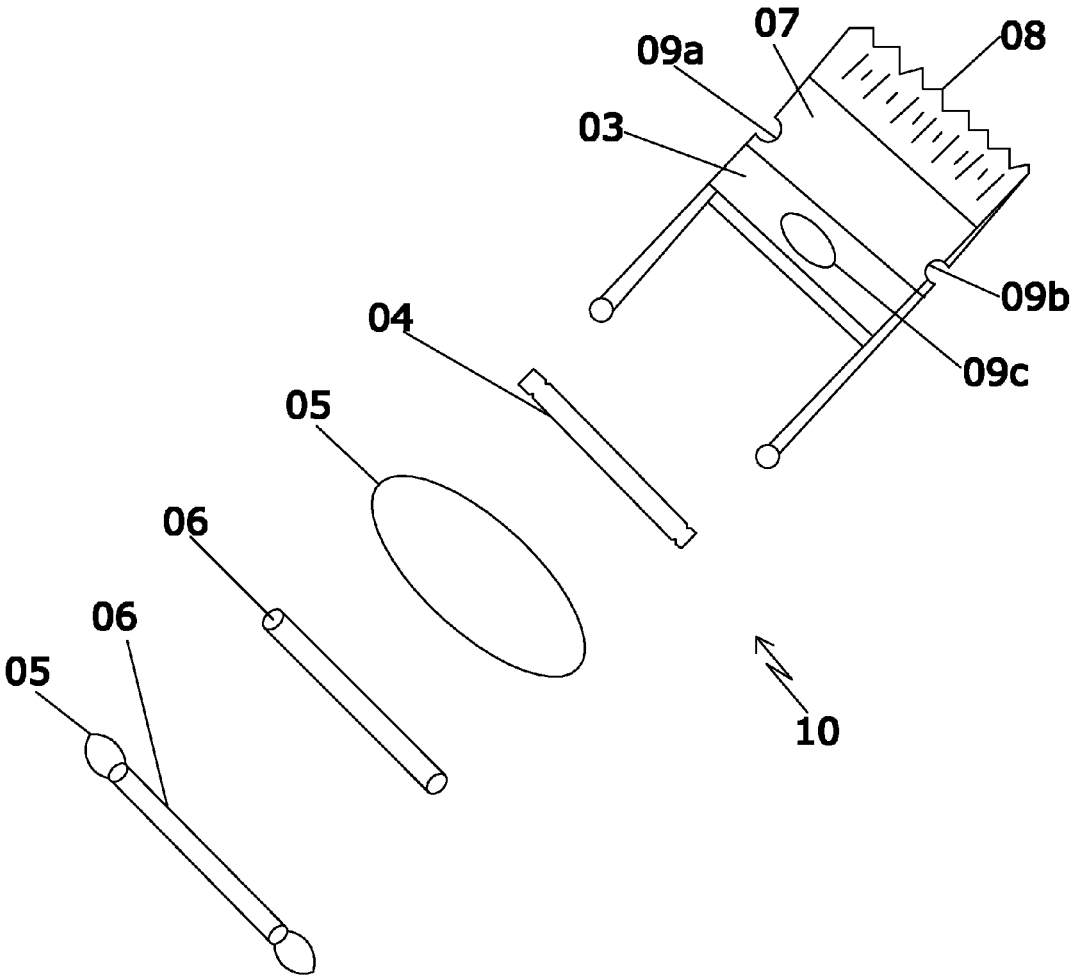
FIG. 2 is an exploded view of a tape dispenser of FIG. 1.

Now referring to FIGS. 1 and 2, the proximal end of the cutter plate 03 includes a pair of leg-members/legs that are removably secured to the extreme ends of second rod 04 to facilitate swiveling of cutter plate 03 about rod 04. More specifically, each of the legs configured on the proximal end of cutter plate 03 includes holes for receiving second rod 04 and facilitates swiveling of cutter plate 03 about rod 04. A window is defined by a lower portion of cutter plate 03 and pair of legs adapted to receive the tape form either side. Second rod 04 is held against roller 01 by pair of flexible bands 05 and first rod 06 disposed beneath the rim, thereby providing sufficient pressure for dispensing of the tape and permitting the adhesive tape dispenser 100 to float smoothly over the roller 01 during operation.

Figure 3:
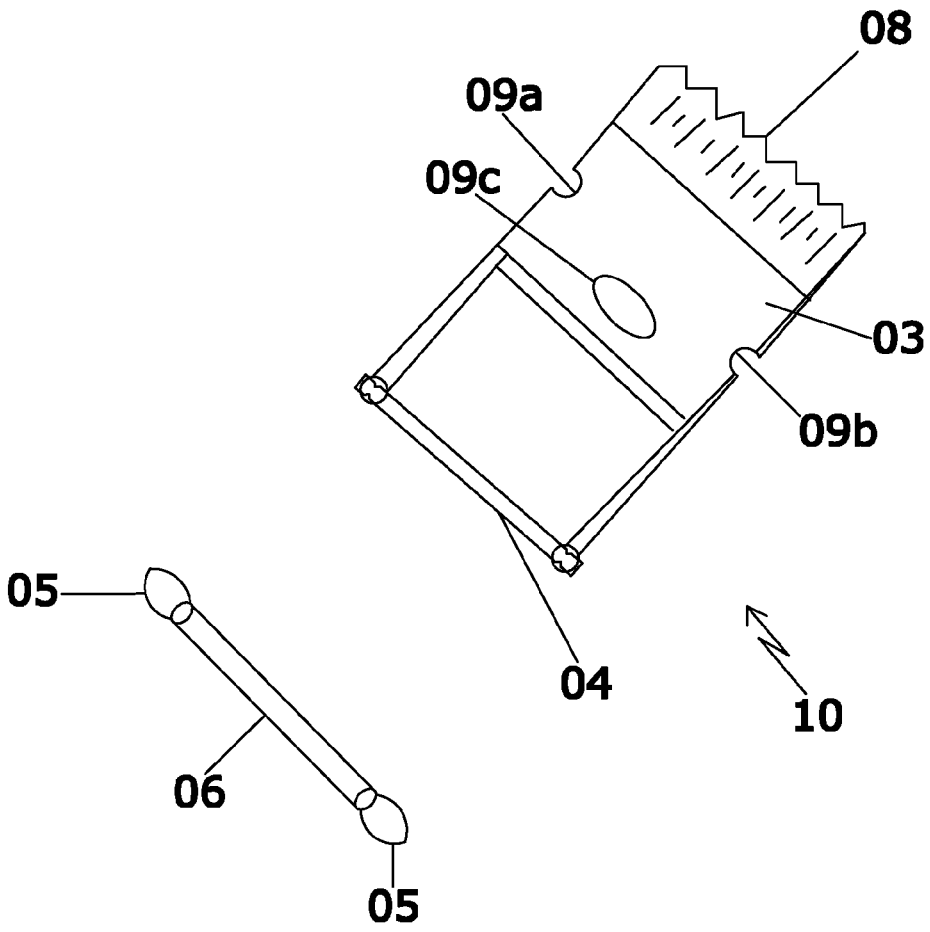
FIG. 3 is a top perspective view of a rod and cutter plate assembly along with a first rod and flexible band assembly of the tape dispenser of FIG. 1.

Referring to FIG. 3, second rod 04 is assembled to cutter plate 03. Second rod 04 is inserted in the holes provided at the extreme ends of the legs extending from cutter plate 03. Rod and cutter plate assembly 10 is then assembled to first rod 06 disposed beneath the rim of the roller by means of the flexible bands 05 and rod and cutter plate assembly 10 floats over the roll 01. Cutter plate 03 along with silicon paper 07 (Refer FIG. 1) further acts as a stay to facilitate sticking of the free end of the tape thereon and thereby convenient locating of the free end of the tape. It is, understood, however, that adhesive tape dispenser 100 may still be used for cutting the tapes even if the adhesive tape dispenser 100 is not mounted on the tape roll.

The cutter plate 03 of rod and cutter plate assembly 10 also includes a pair of notches 09*a* and 09*b* and a central aperture 09*c* configured thereon to facilitate convenient removal of the tape sticking on the silicon paper 07 (Refer FIG. 1). Central aperture 09*c* is preferably placed between the portion of cutter plate 03 covered with silicon paper 07 and the portion of cutter plate 03 that is not covered by silicon paper 07. In this one embodiment, the front and the back sides of cutter plates 03 are preferably similar in configuration, i.e. both front and back sides of cutter plate 03 is provided with area covered with silicon paper 07 and area without silicon paper 07.

The rod and cutter plate assembly 10 is mounted on tape roll 01 with the help of first rod 06 and pair of flexible bands 05. Each flexible band 05 is preferably secured to an extreme end of first rod 06. First rod 06 along with flexible bands 05 secured to the extreme ends thereof is placed underneath the rim of roll 01 and rod and cutter plate assembly 10 is disposed outside the rim of roll 01. First rod 06 disposed inside roll 01 is connected to second rod 04 of rod and cutter plate assembly 10 by means of pair of flexible band 05 such that first rod 06 presses against an internal surface of the wall of tape roll 01 and causes second rod 04 of rod and cutter plate assembly 10 to press against an external surface of the wall of tape roll 01.

Figure 4:
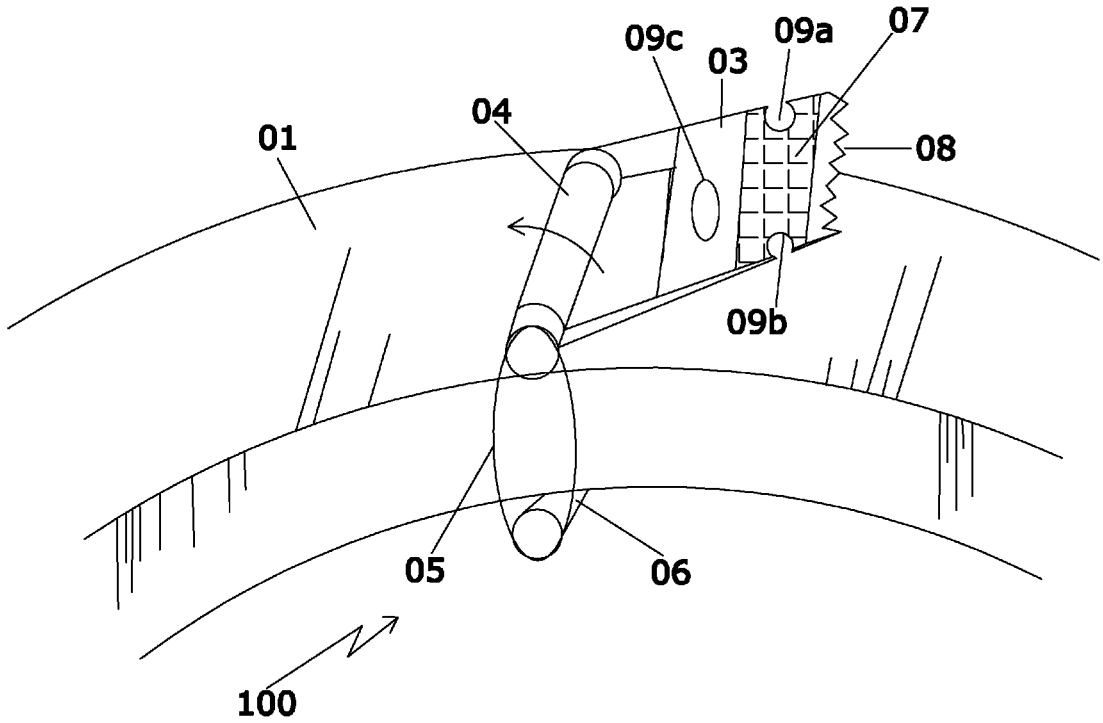
FIG. 4 is a front perspective view of the tape dispenser of FIG. 1 that shows further details of a cutter plate.
Figure 5:
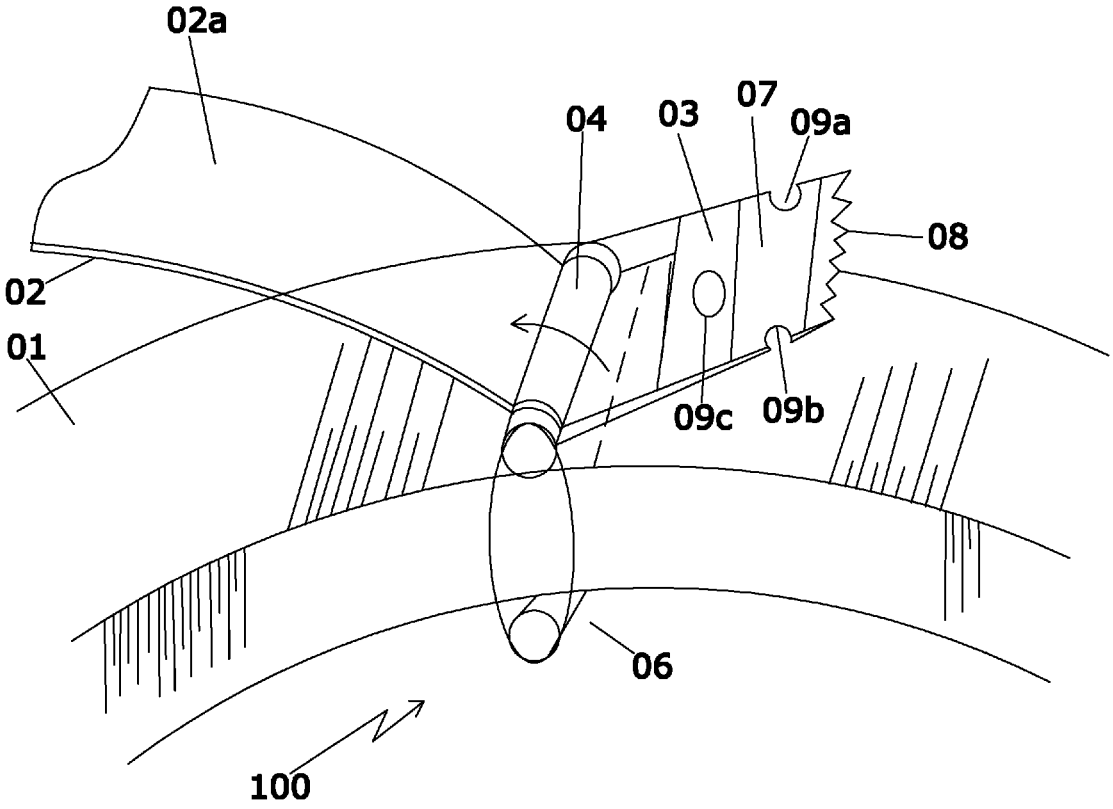
FIG. 5 shows a front perspective view of tape of the tape roll being adjusted with respect to the rod and cutter plate assembly of the tape dispenser of FIG. 1.

Now referring to FIG. 4, a detailed arrangement of tape dispenser 100 mounted on tape roll 01 is shown. Referring to FIG. 5, the tape is drawn from tape roll 01 using tape dispenser 100 such that the sticking surface of tape 02 being drawn is facing upwards and the non-sticking surface of the tape being drawn is in contact with second rod 04 of rod and cutter plate assembly 10 to facilitate peeling and cutting action.

The tape from tape roll 01 is peeled-off the tape roll 01 for the first use thereof, thereafter the tape is made to roll over second rod 04 of rod and cutter plate assembly 10 in such a way that sticky surface of the adhesive tape is facing upward and glossy surface of the adhesive tape is facing downward and is rolling over second rod 04 of rod and cutter plate assembly 10.

The rod and cutter plate assembly 10 is adjusted in such a way that the sticky face of tape 02 is facing silicon paper 07 secured to cutter plate 03. Thereafter, the sticky face 02*a* of the adhesive tape 02 is made to stick on silicon paper 07 secured to cutter plate 03 to facilitate locating of the free end of the adhesive tape for subsequent uses thereof. If the adhesive tape sticks to cutter plate 03, it becomes difficult to separate the tape from cutter plate 03 for the next operations.

The silicon paper 07 prevents the adhesive tape from sticking to cutter plate 03. The use of silicon paper 07 or Teflon material prevents the tape from firmly sticking all along the length of the tape on cutter plate 03.

The cutter plate 03 of rod and cutter plate assembly 10 also includes a pair of notches 09*a* and 09*b* and a central aperture 09*c* configured thereon to facilitate convenient removal of the tape sticking on silicon paper 07 secured to cutter plate 03. The silicon paper 07 secured to cutter plate 03 keeps the free end of the tape free and facilitate holding of the free end of the tape for easy removal of the tape from the middle portion of cutter plate 03. The free end of tape 02 rests onto cutter plate 03 and away from roll 01.

According to still another embodiment of the present invention, rod and cutter plate assembly 10 is adjustable to cater different widths of the adhesive tape. In this another embodiment, instead of using a single cutter plate adapted to swivel about the rod, a plurality of cutter plates, each configured to cater different widths of adhesive tape rollers can be used.

Cutter plate 03 of adhesive tape dispenser 100 is folded to lie along the periphery of the roll for taking up a compact configuration to facilitate convenient packaging of adhesive tape dispenser 100 along with the adhesive tape roll 02. Serrations 08 provided at the distal end of cutter plate 03 of adhesive tape dispenser 100 are adapted to cut the adhesive tape from both sides.

Referring to FIG. 6, an adhesive tape dispenser 200 is mounted on a tape roll 01. Adhesive tape dispenser 200 is provided with a pair of plates, more particularly a cutter plate 103 and a sticking plate 109 is swivably mounted on second rod 104. Cutter plate 103 and sticking plate 109 are pivotable about a common axis. The legs of cutter plate 103 and sticking plate 109 include holes for receiving second rod 104, thereby creating a hinge type assembly.

The rod and cutter plate assembly 110 is mounted on the tape roll 01 with the help of first rod 106 and pair of flexible bands 105, wherein each flexible band 105 is secured to an extreme end of first rod 106. First rod 106 along with flexible band 105 secured to the extreme ends thereof is placed underneath the rim of the roll and rod and cutter plate assembly 110 is disposed outside the rim of the roll.

The first rod 106 disposed inside the roll is connected to second rod 104 of rod and cutter plate assembly 110 by means of pair of flexible band 105 such that first rod 106 presses against an internal surface of the wall of the tape roll 01 and causes second rod 104 of rod and cutter plate assembly 110 to press against an external surface of the wall of the tape roll 01. Such an arrangement with serrations 108 configured on cutter plate 103 and silicon paper 107 applied on the sticking plate 109 is generally used for dispensing tapes of greater widths, where a good and firm grip is required. Sticking plate 109 with silicon paper 107 applied thereto includes a pair of notches 109*a* and 109*b* and a central aperture 109*c* configured thereon to facilitate convenient removal of the tape sticking on silicon paper 107.

Adhesive tape dispenser 200 also includes a sticking plate 109. In this particular embodiment, instead of configuring serrations 108 and silicon paper 107 on the same plate, serrations 108 and silicon paper 107 may be separately configured on cutter plate 103 and sticking plate 109 respectively.

Figure 7:
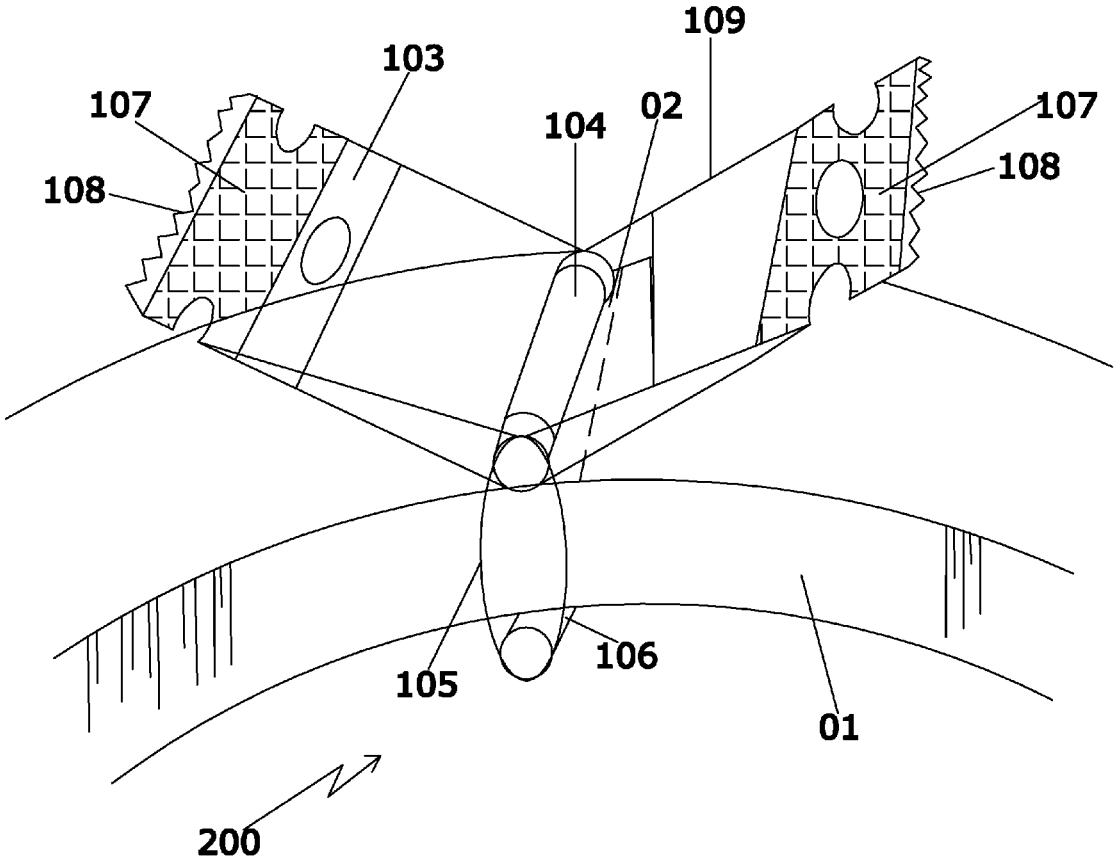
FIG. 7 is a front perspective view of an another embodiment of the tape dispenser of FIG. 6 having the cutter plate on one side of the rod and the sticking plate on opposite side of the rod.

Referring to FIG. 7, a loose end of tape 02 wound over the tape roll 01 is drawn over second rod 104 in such a manner that the sticky surface of the tape is facing sticking plate 109 as the adhesive tape drawn over second rod 104 is being cut by serrations 108 configured on cutter plate 103 disposed opposite to sticking plate 109. According to another embodiment of the present invention, cutter plate 103 and sticking plate 109 are pivotably mounted on two different rods 104*a* and 104*b* respectively instead of being mounted on the same second rod 104.

Referring to FIG. 8*a*, an arrangement utilizing a pair of rods 104*a* and 104*b* for supporting cutter plate 103 and sticking plate 109 respectively of the adhesive tape dispenser 200 is described.

Referring to FIG. 8*b*, another view of adhesive tape dispenser 200 with cutter plate 103 and sticking plate 109 overlapping each other and gripping tape 02 there-between is described.

Now referring to FIG. 9, a tape dispenser 300 in accordance with still another embodiment of the present invention includes an angle 215 that has a horizontal face 215*a* and an operative vertical face 215*b*, wherein the horizontal face 215*a* has a slot 216 configured thereon, through which the free end of tape 02 wound on tape roll 01 passes such that the sticky side 02*b* of tape 02 is facing the vertical face 215*b*. The horizontal face 215*a* of angle 215 is secured to the tape roll 01 by means of a first rod 206. First rod 206 along with flexible bands 205 secured to the extreme ends thereof is placed underneath the rim of the roll and angle 215 is disposed outside the rim of roll 01.

First rod 206 disposed inside the roll is connected to angle 215 by means of pair of flexible bands 205 such that first rod 206 presses against an internal surface of the wall of tape roll 201 and causes the horizontal face 215*a* of angle 215 to press against an external surface of the wall of the tape roll 201. More specifically, the side edges of the horizontal face 215*a* of angle 215 are provided with lugs 211 and 213 (not shown in figure) to facilitate connection between the horizontal face 215*a* and first rod 206. The operative vertical face 215*b* of tape dispenser 300 is provided with serrations 208 configured on an operative top edge thereof to facilitate cutting of the tape.

Referring to FIGS. 11*a*-11*d*, various structural configurations of the plate for the adhesive tape dispenser of FIGS. 1, 6, 9 and 10 are described.

Referring to FIGS. 12*a* and 12*b*, an adhesive tape dispenser 400 in accordance with still another embodiment of the present invention includes only a second rod 302. It is, understood, however, that adhesive tape dispenser may still work without second rod 302. Adhesive tape dispenser 400 is mounted on adhesive tape roll 01 without requiring first rod to facilitate mounting and floating of a cutter plate 303 over the tape roll 01. The cutter plates 303 includes a pair of notches 309*a* and 309*b* and a central aperture 309*c* configured thereon to facilitate convenient removal of the tape sticking on silicon paper 307.

Now referring to FIG. 13, the adhesive tape dispenser with an arrangement for covering the serrations 08 provided on cutter plate 03 is described. The tape drawn from the adhesive tape roller itself acts as a cover for covering the sharp edges of serrations 08 provided on cutter plate 03. Cutter plate 03 acts as a stay on which the adhesive tape sticks. Cutter plate 03 can swivel and lie adjacent to the outer periphery of the tape roll to take up a compact configuration to facilitate convenient packaging of the adhesive tape dispenser along with the tape roll. Further, the position of the stay with respect to the tape roll is maintained minimum in order to prevent sagging of the tape.

Now referring to FIG. 14, an alternative embodiment of an adhesive tape dispenser 500 in accordance with the present invention is described. Adhesive tape dispenser 500 includes a pair of opposed plates 502, a pair of opposed rods 504 that are defined in the body of a cutter plate 506. In this one alternative embodiment, pair of opposed plates 502 are adapted to fixedly hold cutter plate 506. A tape roll 508 is held in position with the help of pair of opposed rods 504. Pair of opposed plates 502 form an opening 510 adapted to cut tape roll 508 from either side. Cutter plate 506 is normal to pair of opposed plates 502 and tape roll 508.

Referring to FIG. 15, another embodiment of an adhesive tape dispenser 520 in accordance with the present invention is described. Adhesive tape dispenser 520 includes a box 522, a rod 524 and a cutter plate 526. In this embodiment, a tape roll 528 is enclosed in box 522. Box 522 includes an opening 530 and a pair of opposed notches 532. Opening 530 facilitates peeling of the tape from box 522. Pair of opposed notches 532 are adapted to hold the uncut portion of the tape for further cutting.

Referring to FIG. 16, in yet another embodiment, tape dispenser 540 includes a cutter 542 having at least two cutting edges defined by serrations 544, a first rod 546, a second rod 548, and a flexible band 550. The cutter plate 542 is positioned on the tape with the first rod 546 and flexible band 550 such that band 550 holds the cutter 542 on the tape with first rod 546. The second rod 548 is advantageously usable for staying the tape.

Now referring to FIGS. 1-5, in operation, the adhesive tape dispenser 100 includes a flexible frame defined by a rod and cutter plate assembly 10 is mounted on the tape roll 01. Rod and cutter plate assembly 10 is mounted on tape roll 01 with the help of the first rod 06 and the pair of flexible bands 05. Each flexible band 05 is preferably secured to an extreme end of first rod 06. First rod 06 along with flexible bands 05 secured to the extreme ends is placed underneath the rim of roll 01 and rod and cutter plate assembly 10 is disposed outside the rim of roll 01. First rod 06 disposed inside the roll 01 is connected to second rod 04 of the rod and cutter plate assembly 10 by means of the pair of flexible band 05 such that the first rod 06 presses against an internal surface of the wall of the tape roll 01 and causes second rod 04 of rod and cutter plate assembly 10 to press against an external surface of the wall of the tape roll 01.

More specifically, pair of flexible bands 05 operates from underneath the rim of roller 01 for facilitating floating of rod and cutter plate assembly 10 over roller 01 whilst maintaining pressure on rod and cutter plate assembly 10. Silicon paper 07 or Teflon material not only prevents the tape from sticking near the serrated end of the cutter plate 03 but also facilitates sticking of the tape to the middle portion of the cutter plate 03, when the tape is cut by the serrations 08 provided at the distal end of the cutter plate 03.

Further, as silicon paper 07 facilitates easy removal of the free end of the tape, the area of the tape following the free end of the tape sticks to the portion of cutter plate 03 where there is no silicon thereby preventing the adhesive tape from getting released from cutter plate 03 and sticking back to roller 01.

More specifically, cutter plate 03 of rod and cutter plate assembly 10 acts as a barrier and prevents the tape from sticking back to roll 01. Once a required length of the adhesive tape is dispensed out of roll 02, the free end of the tape is made to stick on cutter plate 03 such that the adhesive tape covers serrations 08 configured on the distal end of cutter plate 03 to prevent any accidents caused by the sharp edges of serrations 08.

In use, as a user of the adhesive tape dispenser 300 mounted on the roll 01 draws the tape from the roller 01, the roller 01 remains stationary and the adhesive tape dispenser 300 smoothly moves over roller 01 as flexible band 205 and first rod 206 hold rod and cutter plate assembly 10 of adhesive tape dispenser 300 in a floated configuration. Accordingly, because of the peeling action that involves smooth movement with minimum force for drawing the tape, not much effort is required for unwinding the tape.

The adhesive tape dispenser 100 in accordance with the present invention provides major and concise improvements on cutter plate 03 that is of compact configuration and facilitates cutting of the tape. Cutter plate 03 is a multi-purpose plate that serves a variety of different purposes. More specifically, cutter plate 03 floats along the reel, at the same time hold roll 01 by a spring like device so as to float smoothly, and provide action of peeling of the tape to facilitate cutting thereof, with minimum force and at various angles. Cutter plate 03 is able to positively make the non sticking side of the tape to roll on the roller 01 by holding the end of the tape, at the same time keeping the end of the tape free for next operations.

The peeling action requires minimum force for dispensing the tape thereby making the drawing operation simple, less complicated and easy. However, the adhesive tape dispenser 100 of the present invention can also use dragging action of the tape for dispensing a desired length of the tape from the roll. The adhesive tape dispenser 100 ensures positive safety of the tape and also ensures that the loose end of the tape does not stick back to the roller 01. The adhesive tape dispenser 100 may be used for dispensing tape made from different material such as plastic, paper or cloth. The adhesive tape dispenser 100 in accordance with the present invention can be used to cut the tape from both sides i.e. from the sticky side as well as from the glossy side depending upon peeling/dragging direction of the tape and choice of the user.

Tape dispenser 100 of present invention is user friendly, multipurpose and simple in design. Tape dispenser 100 is useful for all varieties of tapes having variations in materials, widths, diameters, thickness, toughness, stickiness. Furthermore, the adhesive tape dispenser 100 in accordance with the present invention can be used in industries where adhesive tapes are frequently and continuously used such as packaging industry, as the adhesive tape dispenser 100 in accordance with the present invention is simple and convenient to use. The adhesive tape dispenser 100 with two-plates is still more convenient to use as the first plate may be used to facilitate sticking of the free end whereas the second plate is used for cutting the tape. The two-plates also facilitate gripping of the tape there-between, while tape is being cut.

The adhesive tape dispenser 100 in accordance with the present invention eliminates the drawbacks associated with prior art tape dispensers, more particularly; the adhesive tape dispenser 100 in accordance with the present invention utilizes peeling action instead of the dragging action for dispensing the adhesive tape from the roll 01. The adhesive tape dispenser 100 for mounting on a tape roll is adapted to prevent sticking of the adhesive tape back to the roll 01 after tape has been peeled-off the tape roll.

In case of adhesive tape dispenser using multiple plates for example, cutter plate and sticking plate for facilitating gripping of the adhesive tape, all the plates are similar in structure and configuration, thereby reducing the overall manufacturing cost and other complications. The sticking plate provides firm grip on the tape to facilitate gripping, positively holding and cutting the tape near a loose end thereof.

The adhesive tape dispenser 100 ensures positive safety of the adhesive tape against any damage thereof, thereby preventing wastage of the adhesive tape. Furthermore, the adhesive tape dispenser 100 facilitates locating of the free end of the adhesive tape for subsequent uses thereof. The adhesive tape dispenser 100 is simple in construction, in-expensive and convenient to use. The adhesive tape dispenser 100 can dispense wider and stickier tapes that require more forces for drawing the tape from the roll 01. The adhesive tape dispenser 100 can cut the tape from both sides. Further, the adhesive tape dispenser 100 can dispense tape from both sides depending upon the direction of peeling of the tape.

The embodiments of the invention shown and discussed herein are merely illustrative of modes of application of the present invention. Reference to details in this discussion is not intended to limit the scope of the claims to these details, or to the figures used to illustrate the invention.

I claim:

1. An adhesive tape dispenser comprising:

a. A frame formed by at least one rod, at least one flexible band and a cutter plate assembly;

b. the cutter plate assembly has i. a cutter plate with a proximal end and a distal end, wherein the distal end of the cutter plate has serrations to facilitate cutting of adhesive tape and a non stick liner secured at the distal end before the serrations, wherein the non stick liner enables a user to locate and separate a free end of the adhesive tape from a tape roll;

ii. the proximal end has at least one pair of leg-members removably secured to extreme first and second ends of a second rod;

iii. a window is defined by the proximal end of the cutter plate and the pair of the leg members connected to the second rod to receive the tape from either side;

c. a first rod having extreme first and second ends;

iv. at least one flexible band extending from the first and second extreme ends of the second rod to the first and second extreme ends, respectively, of the first rod;

the cutter plate assembly is mounted on the tape roll by means of the second rod and the first rod and the at least one flexible band, wherein the first rod extends through an aperture of the tape roll and the second rod resting on the tape roll to facilitate cutting of the adhesive tape.

2. The adhesive tape dispenser as claimed in claim 1, wherein the cutter plate has at least one of at least one notch in outer edges of the cutter plate or at least one aperture through the cutter plate to facilitate removal of the tape.

3. The adhesive tape dispenser as claimed in claim 1, wherein the non stick liner is at least one of a silicon paper or Teflon paper to facilitate removal of the tape.

4. An adhesive tape dispenser comprising:

a. A frame formed by at least two rods and a cutter plate assembly;

b. The cutter plate assembly has i. a cutter plate with a proximal end and a distal end, wherein the distal end of the cutter plate has serrations to facilitate cutting of adhesive tape and a non stick liner secured at the distal end before the serrations, wherein the non stick liner enables a user to locate and separate a free end of the adhesive tape from a tape roll;

ii. the proximal end has at least one pair of leg-members removably secured to extreme first and second ends of a second rod;

iii. a window is defined by the proximal end of the cutter plate and the pair of the leg members connected to the second rod to receive the tape from either side;

c. a first rod having extreme first and second ends;

d. a pair of elastic rubber bands;

iv. one of the elastic rubber bands extend from the first extreme end of the second rod to the first extreme end of the first rod and the other elastic rubber band extends from the second extreme end of the second rod to the second extreme end of the first rod;

the cutter plate assembly is mounted on the tape roll by means of the two rods and the pair of elastic rubber bands, the first rod extending through an aperture of the tape roll and the second rod resting on the tape roll are held by means of the elastic rubber bands.

5. The adhesive tape dispenser as claimed in claim 4, wherein the cutter plate has at least one notch in an outer periphery to facilitate removal of the tape.

6. The adhesive tape dispenser as claimed in claim 4, wherein the non stick liner is at least one of a silicon paper or Teflon paper.

* * * * *